United States Patent [19]

Bird

[11] Patent Number: 4,938,991

[45] Date of Patent: Jul. 3, 1990

[54] SURFACE PROTECTION METHOD AND ARTICLE FORMED THEREBY

[75] Inventor: Jay S. Bird, Arlington, Tex.

[73] Assignee: Dresser Industries, Inc., Dallas, Tex.

[21] Appl. No.: 280,444

[22] Filed: Dec. 6, 1988

Related U.S. Application Data

[62] Division of Ser. No. 30,408, Mar. 25, 1987, Pat. No. 4,814,234.

[51] Int. Cl.[5] ..... B05D 1/36

[52] U.S. Cl. ..... 427/190; 427/191; 427/193

[58] Field of Search ..... 427/190, 191, 203

[56] References Cited

U.S. PATENT DOCUMENTS

| | | | |
|---|---|---|---|
| 2,173,484 | 9/1939 | Lerch et al. | 427/190 X |
| 2,223,864 | 12/1940 | Zublin | 175/375 |
| 2,833,638 | 5/1958 | Owen | 428/564 |
| 3,023,130 | 2/1962 | Wasserman et al. | 428/564 |
| 3,071,489 | 1/1963 | Pelton et al. | 428/564 |
| 3,190,560 | 6/1965 | Schilling et al. | 239/85 |
| 3,262,644 | 7/1966 | Schilling et al. | 239/86 |
| 3,282,358 | 1/1966 | Carothers | 175/411 |
| 3,800,891 | 4/1974 | White et al. | 175/314 |
| 4,013,460 | 3/1977 | Brown et al. | 419/18 |
| 4,039,700 | 8/1977 | Sohmer et al. | 427/191 X |
| 4,055,742 | 10/1977 | Brown et al. | 428/564 |
| 4,136,230 | 1/1979 | Patel | 428/564 |
| 4,396,077 | 8/1983 | Radtke | 175/329 |
| 4,593,776 | 6/1986 | Salesky et al. | 175/375 |
| 4,689,242 | 8/1987 | Pike | 427/203 X |

FOREIGN PATENT DOCUMENTS

| | | | |
|---|---|---|---|
| 0266990 | 12/1963 | Australia . | |
| 836730 | 6/1960 | United Kingdom | 427/191 |

*Primary Examiner*—Shrive Beck

*Attorney, Agent, or Firm*—Daniel Rubin

[57] ABSTRACT

The disclosed invention describes a method for cladding surfaces of an earth boring apparatus, or the like, with a hardfacing material having an entrained, or encapsulated, heavy metal refractory carbide. The method includes heating the surface to the incipient melting temperature and applying a molten super-alloy matrix material that has a melting temperature below the melting temperature of the carbide. The super-alloy, in a powder form, is pre-mixed with the carbide material, also in a powder form, such that, when the molten surface and the molten super-alloy cool, they form a metallurgical bond, at the surface, with the carbide material mechanically retained within the solidified matrix material.

18 Claims, 1 Drawing Sheet

SURFACE PROTECTION METHOD AND ARTICLE FORMED THEREBY

This is a division, of application Ser. No. 07/030,408, filed Mar. 25, 1987, now Pat. No. 4,814,234.

FIELD OF THE INVENTION

This invention relates generally to a method of applying a hardfacing material to a working surface of a metal part and the article formed thereby, and more particularly, to a method of applying a powdered heavy metal refractory carbide, such as tungsten carbide, to a steel surface, and in particular, to the surfaces of a drill bit or tool that are important to be maintained relatively free from the loss of material due to abrasion or erosion during drilling operations.

DESCRIPTION OF THE PRIOR ART

It is highly desirable, in certain applications, to make the working surface of a steel part extremely wear resistant. Also, because of the difficulties and expenses in machining wear resistant material, it is common practice to form the underlying steel body into the final configuration and subsequently, treat the surface, as by hardening, or applying a wear resistant material thereto, depending upon the wear resistance desired.

In applications where resistance to extreme wear is required of a steel article, a cladding or hard, wear resistant material is applied to the wear surface of the article, providing a wear resistant layer supported by the underlying resilient body. However, heretofore, joining certain wear resistant materials to steel body created a problem in the endurance life of the component. This is particularly true when applying a heavy metal refractory carbide such as tungsten carbide hard face material to a steel bodied article.

Tungsten carbide hardfacing is conventionally applied by welding techniques whereby the surface of the base material is heated sufficiently to melt and encapsulate the carbide particles placed upon the base material, either before or during the application process. With such process a metallurgical bond is formed. In certain less stringent applications, tungsten carbide is applied by plasma spray techniques. With a plasma spray process the base material is not melted and the total heat and kinetic energy of the process induces bonding between the carbide material and the base metal, forming what is known as a mechanical bond. Metallurgical bonds are, for the most part, superior to mechanical bonds in strength.

With a metallurgical bond between the tungsten carbide and the base material, encapsulation of the carbide always involves some dissolution around the carbide particles are compared to the base material, thus creating a relatively brittle composite material (i.e., dissolved tungsten carbide and steel) around the remaining tungsten carbide particles. This composite or matrix material becomes highly stressed during cooling of the weldment. Subsequent thermal treatment adds further stress to this matrix layer due to the differences of thermal expansion between the matrix and the base material. Because of the greater thermal expansion rate of the base material, the matrix upon heating (as in heat treatment operations) relieves its accumulated stress by cracking. Such cracks often propagate into the base material, thereby weakening the entire structure. An example of such a process and the product formed thereby, is shown in U.S. Pat. No. 3,800,891.

In the plasma spray method, a weaker bond is created between the tungsten carbide layer and the steel base such that during use, the carbide material flakes or chips off, exposing the relatively soft underlying steel surface to a high rate of wear or erosion.

Another well known technique for applying tungsten carbide hardfacing is a flame spray application which also produces a mechanical bond with a high degree of porosity. Flame sprayed coatings are not as well bonded as those which are plasma sprayed. However, hardfacing coatings which are applied through a combination of both flame spray and fusion exhibit a metallurgical bond which is wholly dense and extremely abrasion resistant. Conventional welding and flame spraying the hardfacing layer causes high stresses in the hardfacing (as discussed above) that will lead to deleterious cracking if subjected to further thermal treatment.

The intent of this invention is to apply a heavy metal refractory carbide hardfacing material with a metallurgical bond to the base material, and controlling the matrix material composition (metallurgy) to substantially eliminate its propensity to crack under subsequent heat treatments, while not affecting the servicability of the hardfacing coating.

SUMMARY OF THE PRESENT INVENTION

The present invention is directed to a method, and the product formed by the method, of adhering a heavy metal refractory carbide such as tungsten carbide on the surface of a base metal, preferably a steel body, to provide a wear resistant coating to the working surface of the body, and having the coating metallurgically bonded thereto with sufficient strength such that it does not readily flake or chip off, during use, even under extreme abrasion or erosion inducing conditions, such as downhole drilling. More importantly, however, the bonding is completed without any tendency to embrittle or otherwise affect the characteristics of the underlying base metal, eliminating the tendency of the coating to crack into the base material during subsequent heat treatment or severe use. In fact, a matrix material with which the carbide hardfacing bonding material is mixed prior to its application to the article, and which, in this process, is metallurgically bonded to the base material of the article, is primarily comprised of a nickel or cobalt alloy (commonly referred to as super-alloys) which has mechanical and thermal properties that allow it to plastically deform, without cracking, to accommodate the variable expansion and contraction of the base material during subsequent heat treatments, and flexure during use to retain the carbide component of the hardfacing material in place under such conditions.

Further, the process of the present invention permits the bonding of a superior tougher cladding that includes, in the cladding, bulk carbide particles also bonded by the super-alloy matrix material. As such, the method comprises initially applying, with an adhesive such as water glass, a bulk heavy metal refractory carbide such as tungsten carbide material, either cast or sintered of 16–45 mesh to the appropriate surface of the article. Secondly, the water glass is dried to adhere the bulk carbide material temporarily to the article. Next, the surface of the article on which the bulk carbide has been adhered is heated, as with a flame torch, to the incipient melting temperature (i.e., the lowest temperature at which any of the components of the base alloy become molten on the surface of the article, which, in the case of steel is around 2600° F. surface temperature). A fine powder mixture of a heavy metal refractory carbide is initimately mixed with like-sized super-alloy based matrix powder (i.e., having a predominant cobalt or nickel content), and mixed on approximately a 50/50 basis by weight, is applied through a flame spray in a manner such that the reducing flame melts the powdered matrix material but does not melt or degrade the entrained carbide power. Upon completion of the spraying, the hardfacing layer is fused using the flame spray gun. Surface temperatures of 1850° to 2100° F. are achieved during fusing. The incipient melting at the surface of the base material mixes with the molten matrix material to fuse the layer, thereto forming a hard wear resistant surface encapsulating both the powdered and the bulk carbide material and metallurgically bonding the flame sprayed material to the base material in a manner that deters flaking, but yet, because of the ductility of the super-alloy matrix material, does not embrittle or weaken the base material under processing or usage environments.

DESCRIPTIONS OF THE DRAWINGS

DESCRIPTION OF THE PREFERRED EMBODIMENT

Figure 1:
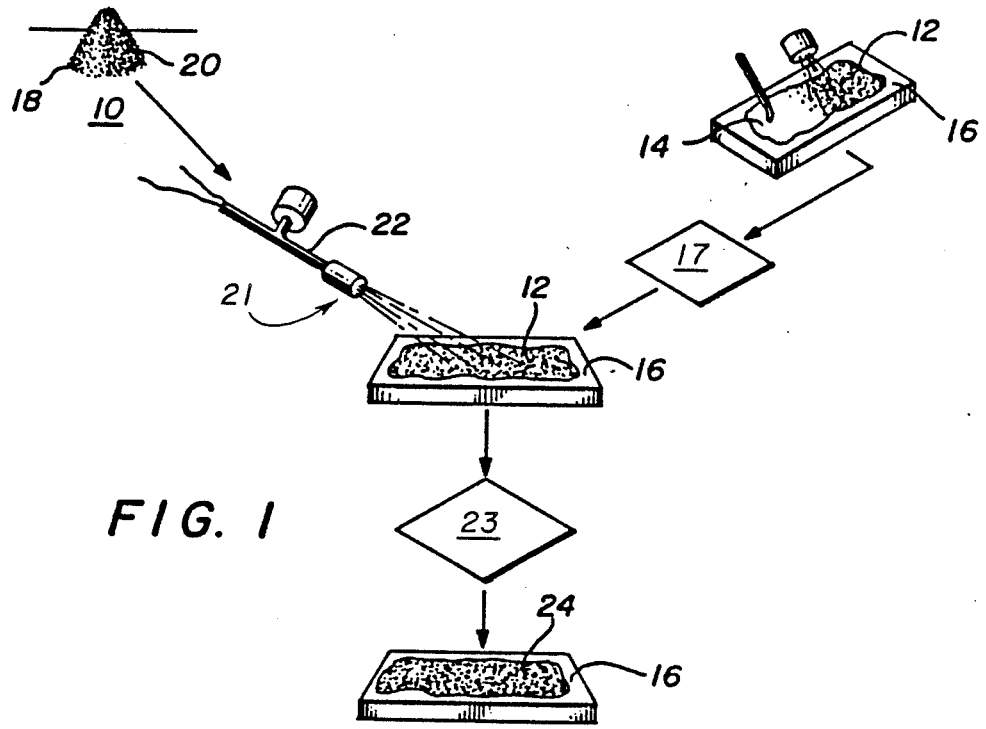
FIG. 1 is a schematic illustration of the method of the instant invention.

Referring to FIG. 1, the hardfacing method of the present invention is disclosed as shown in the schematic diagram illustrating the various steps of the method. As therein see, a bulk heavy metal refractory carbide material 12 is adhered to the particular surface of an article 16 that requires a hard, wear resistant surface. The bulk carbide 12 can be either a sintered or cast carbide sized between 16–45 mesh, and is applied in any predetermined pattern or area. It is initially adhered to the surface through a water base adhesive 14 such as water glass. The article 16, with the adhesively retained bulk carbide 12, is permitted to dry as by air drying at 17, or, to shorten the process, a low temperature baking.

A cobalt-coated heavy metal refractory carbide such as tungsten carbide powder 18 is mixed with a super-alloy based powder or matrix 20, generally in the ratio of approximately 50% of each, by weight, forming a blended hardfacing spray powder 10. A cobalt-coated tungsten carbide powder 18 is generally available commercially as a tungsten carbide plasma spray hardfacing powder, and the super-alloy based matrix powder, blended therewith, is also a generally commercially available flame spray powder such as Stellite (Co-base) or Deloro (Ni-base). (Stellite and Deloro are trademarks of Stoody Deloro Stellite Inc., for cobalt base wear resistant alloys and for nickel, chromium, boron, silicon wear resistant alloys respectively.) The refractory carbide powder 18 is sized on the order of −325 mesh U.S. Standard sieve and the matrix powder 20 is sized on the order of −200 mesh, providing a fine powder blend.

The surface of the article 16 having the adhesively applied bulk carbide 12 is then heated to the incipient melting temperature of the article base metal (i.e., on the order of 2600° F. at the surface). This surface heating process can be accomplished by any convenient means, but in the preferred embodiment is accomplished through an oxi-acetylene torch 22 using a reducing flame which has a flame temperature of approximately 5300°–5500° F. Once the surface 16 to be hardfaced is heated to the appropriate temperature to initiate at least some initial melting of the base metal at the surface, but below the melting temperature of the bulk carbide, the mixed powder 10 is introduced at 21 to the surface, as through the oxi-acetylene spray torch 22, as is well known in the art for applying a powdered metal to a surface, raising the temperature of the super-alloy based matrix material 20 to its braze and fusion temperature of approximately 1850°–2100° F. This liquifies the super-alloy based matrix powder 20, but is not of a temperature that melts or otherwise degrades the carbide component 18 in the blended powder mixture 10. Also, it is to be noted that in air, heavy metal refractory carbide will begin to degrade (i.e. oxidize) at approximately 900° F; however, the flame of the spray torch 22 is maintained in a reducing condition, so that the carbide is not oxidized.

The fine mesh size of the flame-spray applied blended powder 10, in addition to facilitating the super-alloy based matrix component 20 to readily melt within the oxi-acetylene flame, also facillitates the dispersement of the entrained carbide powder component 18 throughout the melted matrix 20, cladding the appropriate surface of the base and providing a bonded interface between the base material 16 and the bulk carbide 12 so that there are minimal (if any) voids or surface discontinuities. The bulk carbide 12 is thereby fused, in the nature of brazing, to the surface of the base material 16 through a matrix material that itself has, generally equally distributed throughout, a significant component of carbide powder 18 providing a tough and durable hardfacing cladding 24.

The article 16, subsequent to the fusion application of the cladding 24 to the article 16, as above described, is allowed to cool and then heat treated at 23 as by being austenitized between 1475°–1550° F., oil quenched and tempered at approximately 350° F. resulting in a heat treated hardfaced article 16, able to present a tough, highly dense, pore-free hardface cladding layer 24 as a wear or abrasion resistant surface metallurgically bonded to the base metal. The super-alloy based matrix material 20 is fused to the base metal and entrains therein both the bulk and powdered carbide in a manner that minimizes flaking or chipping. Further, the fusion of the matrix material 20 with the surface melting of the base metal at a temperature below which any dissolusion of the carbide occurs, provides a ductile matrix fusion that has minimal cracks and prevents propagation of cracks from the hardfacing into the base material. This process, therefore, avoids the embrittlement problem heretofore described, and greatly reduces the flaking or detachment problem heretofore accompanying methods for applying a hardface material.

Figure 2:
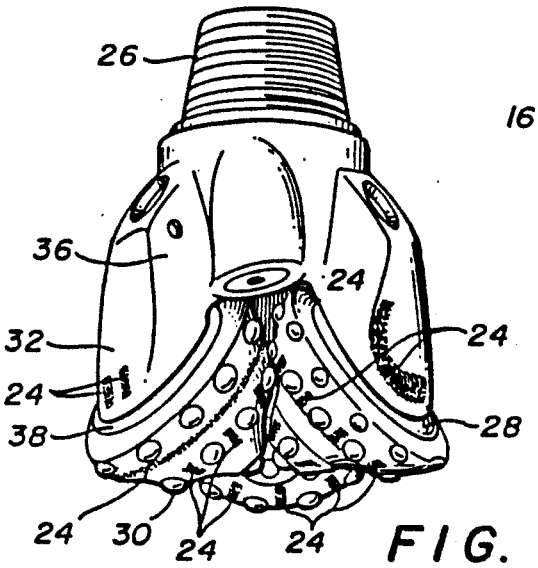
FIG. 2 is an isometric view of a rotary drill bit illustrating a patterned application of the hardfacing on selective wear surfaces thereor.

Reference is now made to FIG. 2 to show the application of the material 18, 20, 12 to provide a hardfaced 24 surface at various exposed surfaces of a steel bodied rolling cutter drillbit 26 that, without special treatment, are readily eroded or abraded away. As is seen in FIG. 2 the hardfacing layer 24 can be easily applied in a patterned or predetermined array so that the relatively expensive hardfacing materials 18, 20, 12 can be judiciously utilized in those areas from which the most benefit can be obtained. Therefore, it can be seen that, as applied to the rolling cone 28 of a drill bit 26, the material 24, at present, is applied between adjacent cutting elements 30 of a common circumferential row thereof or is applied circumferentially between adjacent rows to prevent erosion of the base material in an area that, if left otherwise exposed, would erode to the extent that the cutting elements 30 would become dislodged from their sockets. Further, it is seen that the hardfacing 24 will be applied to the shirttail area 32 of the cutter arms 36 in a manner, such as a patterned array or a continuous layer, that prevents the shirttail 32 from eroding or abrading away prematurely, and which would, if abraded away, expose the internal seal, adjacent the bearing cavity at the base 38 of the cone 28 directly to the downhole mud. Other areas and patterns on various downhole drilling tools are also available candidates for the application of this material in the disclosed manner.

Figure 3:
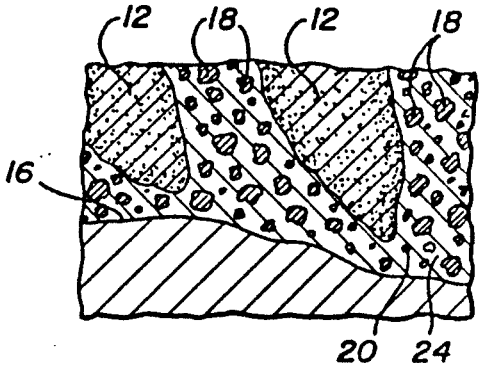
FIG. 3 is a cross-sectional view of the hardfacing material as applied to a base metal illustrative of a photomicrographic view detailing the bonded layer of the hardfacing material.

Reference is now made to FIG. 3 which shows a schematic illustration of a phtomicrograph of approximately 200 times enlargement of a cross section of a surface 16 having the hardface layer 24 of material 18, 20, 12 of the above invention fused thereto in accordance with the above technique. As therein seen, the hardface layer 24 is comprised of the bulk carbide 12 that provides an aggressive wear resistant surface. The smaller particles are the powdered carbide 18, entrained in the super-alloy based matrix 20 that adheres to the bulk material 12 and is metallurtgically bonded to the article surface 16. It is thus clearly seen that the matrix material 20 flows to positions below and between the bulk carbide 12 and the article surface 16 to fill all voids, to provide maximum bonding of the bulk carbide 12 to the surface 16; and further, that the heavy metal refractory carbide powder 18 is dispersed throughout the matrix material 20, to give an unsurpassed wear resistant quality to the super-alloy based matrix material so that it is not readily worn away and, in fact, provides a tough hardface cladding to the surface even without the inclusion of the bulk carbide. The uneven surface of the base material, as shown in FIg. 3, is illustrative of how surfaces appear at high magnification.

I claim:

1. A method of forming a layer of wear resistant material, inlcuding a heavy metal refractory carbide, on selective surface areas of a metal alloy surface comprising the steps of:

a. applying a heavy metal refractory carbide materials to said selective surface areas;
b. heating said surface areas to the incipient surface melting temperature of said alloy;
c. applying a fine powder super-alloy based matrix metal to said previously heated surface areas;
d. heating the powder matrix metal to a temperature sufficient for the matrix metal to become molten, but below the melting temperature of said heavy metal refractory carbide, while maintaining said surface areas at said surface areas at said incipient surface melting temperature for a predetermined controlled time duration less than a time duration in which significant alloying diffusion can occur;
e. permitting the molten matrix metal to flow to cover said selective surface areas and encapsulate said unmolten carbide material; and
f. cooling said molten metal to metallurgically bond the matrix metal to said surface areas while mechanically encapsulating said heavy metal refractory carbide.

2. The method of claim 1 wherein said step of applying a heavy metal refractory carbide material to said surface areas includes;

a. an initial application of a heavy metal refractory carbide material to said selective surface areas; and,
b. a subsequent application of a heavy metal refractory carbide material applied in conjunction with the application of said fine super-alloy based powder matrix metal to said surface areas.

3. The method of claim 2 wherein said initial application of carbide material includes adhereing bulk carbide granules to said areas.

4. The method of claim 3 wherein said fine super-alloy based powder matrix and said carbide material of said subsequent application both comprise a fine powder blend applied through a flame-spray to effect said heating of said super-alloy based matrix metal.

5. The method of claim 4 wherein said flame-spray when heating said super-alloy matrix maintained as a reducing flame to prevent oxidation of said carbide material.

6. The method of claim 5 wherein said bulk carbide granules and said heavy metal refractory carbide material of said subsequent application both comprise a tungsten carbide material.

7. The method of claim 1 including the post-cooling step of heat treating the metal alloy surface and wear resistant material fused thereto.

8. A method of forming a layer of wear-resistant material, including a heavy metal refractory carbide, on selective surface areas of a metal alloy surface comprising the steps of;

a. adhering carbide granules to said surface areas;
b. heating said surface areas to the incipient surface melting temperature of said alloy;
c. applying a fine powder mixture of a blend of heavy metal refractory carbide and a super-alloy based matrix metal to said previously heated surface areas;
d. heating the blended powder to a temperature sufficient for the matrix metal to become molten, but below the melting temperature of said carbide, while maintaining said surface areas at said incipient surface melting temperature for a predetermined controlled time duration less than a time duration in which significant alloying diffusion can occur;
e. permitting the molten matrix metal to flow to cover said selective heated surface areas carrying powdered unmolten carbide to generally cover said surface areas, and encapsulate said carbide material disposed thereon; and
f. allowing said areas of molten metal to cool to weld the matrix metal to said surface areas while mechanically encapsulating said carbide material.

9. The method of claim 8 wherein said heating the blended powder is effected with a torch having a flame maintained as a reducing flame to prevent oxidation of said carbide material.

10. The method of claim 8 wherein said fine powder mixture of heavy metal refractory carbide and said super-alloy based matrix metal is applied through said torch as a flame-spray applied material to said surface areas.

11. The method of claim 7 including the post-cooling step of heat treating the metal alloy surface and wear resistant material welded thereto.

12. An improved method of producing an earth boring apparatus having a body portion formed of a steel alloy and defining thereon surface areas particularly susceptible to wear or erosion during use, said areas having a hard-face cladding applied thereto to retard said wear or erosion and wherein said improvement comprises forming said cladding by the steps of:

a. applying a granular heavy metal refractory carbide material to said surface areas;
b. heating said surface areas to the incipient surface melting temperature of said steel alloy;
c. applying a fine powder super-alloy based matrix metal to said previously heated surface areas;
d. heating the powder matrix metal to a temperature sufficient for the matrix metal to become molten, but below the melting temperature of said heavy metal refractory carbide, while maintaining said surface areas at said incipient surface melting temperature for a predetermined controlled time duration less than a time duration in which significant alloying diffusion can occur;
e. permitting the molten matrix metal to flow to cover said selective surface areas and encapsulate said unmolten carbide material; and
f. cooling said molten metal to metallurgically bond the matrix metal to said surface areas while mechanically encapsulating said carbide.

13. The method of claim 12 wherein said step of applying a granular carbide material to said surface areas includes;

a. an initial application of bulk heavy metal refractory carbide material to said selective surface areas; and,
b. a subsequent application of powdered heavy metal refractory carbide material applied in conjunction with the application of said fine super-alloy based powder matrix metal to said surface areas.

14. The method of claim 13 wherein said initial application of carbide material includes adhering bulk carbide granules to said areas.

15. The method of claim 14 wherein said fine super-alloy based powder matrix and said heavy metal refractory carbide material of said subsequent application both comprise a fine powder blend applied through a flamespray to effect said heating of said super-alloy based matrix metal.

16. The method of claim 15 wherein said flame-spray when heating said super-alloy matrix is maintained as a reducing flame to prevent oxidation of said carbide material.

17. The method of claim 15 wherein said bulk carbide granules and said heavy metal refractory carbide material of said subsequent application both comprise a tungsten carbide material.

18. The method of claim 10 including the post-cooling step of heat treating the metal alloy surface and wear resistant material fused thereto.

* * * * *

UNITED STATES PATENT AND TRADEMARK OFFICE

CERTIFICATE OF CORRECTION

PATENT NO. : 4,938,991

DATED : July 3, 1990

INVENTOR(S) : Jay S. Bird

It is certified that error appears in the above-identified patent and that said Letters Patent is hereby corrected as shown below:

Column 1, line 29 "cladding or hard" should read -- cladding of hard --;

Column 1, line 33 "to steel body" should read -- to a steel body --;

Column 3, line 41 " therein see" should read -- therein seen --;

Column 5, line 24 "phtomicrograph" should read -- photomicrograph --;

Column 6, line 15 "adhereing" should read -- adhering --;

Column 6, line 23 "matrix maintained" should read -- matrix is maintained --;

Column 6, line 64 "of claim 8" should read -- of claim 9 --;

Column 7, line 1 "of claim 7" should read -- of claim 8 --;

UNITED STATES PATENT AND TRADEMARK OFFICE

CERTIFICATE OF CORRECTION

PATENT NO. : 4,938,991

DATED : July 3, 1990

INVENTOR(S) : Jay S. Bird

It is certified that error appears in the above-identified patent and that said Letters Patent is hereby corrected as shown below:

Column 8, line 27 "of claim 10" should read -- of claim 12 --.

Signed and Sealed this

Twenty-fifth Day of June, 1991

*Attest:*

*Attesting Officer*

HARRY F. MANBECK, JR.

*Commissioner of Patents and Trademarks*